US005839736A

United States Patent [19]

Chiu et al.

[11] Patent Number: 5,839,736

[45] Date of Patent: Nov. 24, 1998

[54] IN LINE SKATE CONSTRUCTION

[75] Inventors: Shin Khoo Chiu, North Point; Kai Nin So, Happy Valley, both of Hong Kong

[73] Assignee: Marco Skates Limited, Chaiwan, Hong Kong

[21] Appl. No.: 799,794

[22] Filed: Feb. 12, 1997

[51] Int. Cl.[6] ..... A63C 17/00

[52] U.S. Cl. ..... 280/11.22; 36/115

[58] Field of Search ..... 280/11.22, 11.23, 280/11.27, 11.19; 36/113, 115, 117.1, 117.3

[56] References Cited

U.S. PATENT DOCUMENTS

| | | | |
|---|---|---|---|
| 5,171,033 | 12/1992 | Olson et al. | 280/11.22 |
| 5,388,846 | 2/1995 | Gierveld | 280/11.22 |
| 5,645,288 | 7/1997 | Lu | 280/11.22 |
| 5,678,833 | 10/1997 | Olson et al. | 280/11.22 |
| 5,735,537 | 4/1998 | Zorzi | 280/11.22 |
| 5,775,706 | 7/1998 | Caeran | 280/11.22 |

*Primary Examiner*—Richard M. Camby
*Attorney, Agent, or Firm*—Charles E. Tenko

[57] ABSTRACT

An in-line skate construction includes a soft shoe element that replaces a conventional molded boot type having a foot enclosure. The shoe element is fixed in position using a pair of screws which penetrate the sole of the shoe element, a foot frame element and a chassis element to engage corresponding nuts, thereby enabling the shoe element to be manually attached to the chassis element and removed for washing, replacement, and separate wearing by the user. The heads of the screws are recessed in shaped washers positioned within the shoe element so as to avoid projections under the foot and heel of the wearer. The shoe element is of standard height and is independent of an ankle cuff, so that it may be open at the upper portion thereof for improved air circulation.

4 Claims, 4 Drawing Sheets

IN LINE SKATE CONSTRUCTION

BACKGROUND OF THE INVENTION

This invention relates generally to the field of in-line roller skates, and more particularly to an improved construction offering superior comfort to the wearer enabled by the elimination of the usual rigid molded boot type enclosure for the foot of the wearer.

As contrasted with the older four wheel tandem type skate, in-line skates require a much greater degree of ankle support when in use than is the case with the tandem type skate. In the latter, the contact of the four wheels with the surface being traversed provides a degree of stability which eliminates the need for supporting the ankle of the user against twisting forces about an axis parallel to the path of travel. In the in-line skate, the chassis may tilt about this axis causing stress upon the ankle of the wearer to a substantial degree.

To resolve this problem, prior art devices have used a relatively rigid boot and accompanying ankle supporting cuff which pivots about the skate on an axis perpendicular to the path of travel. This construction may be effective, but has the accompanying disadvantage of generating heat within the boot which causes discomfort to the user. Attempts have been made to ventilate the boot, which have met only limited success.

It is known in the art to provide means for engaging a separable shoe upon the skate frame which shoe is relatively non rigid, and, more importantly, is capable of breathing during use. Typical devices are described in U.S. Pat. Nos. 3,963,252; 4,418,929; and 5,069,462.

A recent contribution to the art is described in U.S. Pat. No. 5,437,466 to Meibock, et al. In this disclosure, the shoe is of breathable material and is maintained in position by inserting the toe portion into a recess formed in the frame. A strap encloses the ankle cuff and surrounds the upper portion of the shoe which extends into the cuff. The shoe may be released by opening the cuff strap. While not without utility, this construction does not positively connect the sole of the shoe to the upper surface of the frame, and during skating, the heel of the shoe can part contact with the frame accompanied by a sliding or rubbing action between the upper portion of the shoe and the inner surface of the cuff, which action imparts a feeling of instability to the user.

SUMMARY OF THE INVENTION

Briefly stated, the invention provides an improved construction in which the above-mentioned disadvantage is eliminated. This is accomplished by providing a pair of screws which are inserted from within the shoe through aligned openings in the sole, the frame element, and the chassis element to be secured to the chassis element so as to hold the shoe in position. The head of the screw may be recessed within a large washer to eliminate pressure being applied by the sides of the head against the sole of the foot of the user.

BREIF DESCRIPTION OF THE DRAWINGS

An in-line skate construction according to the invention will now be described by way of example with reference to the accompanying drawings in which.

DETAILED DESCRIPTION OF THE DISCLOSED EMBODIMENT

Figure 1:
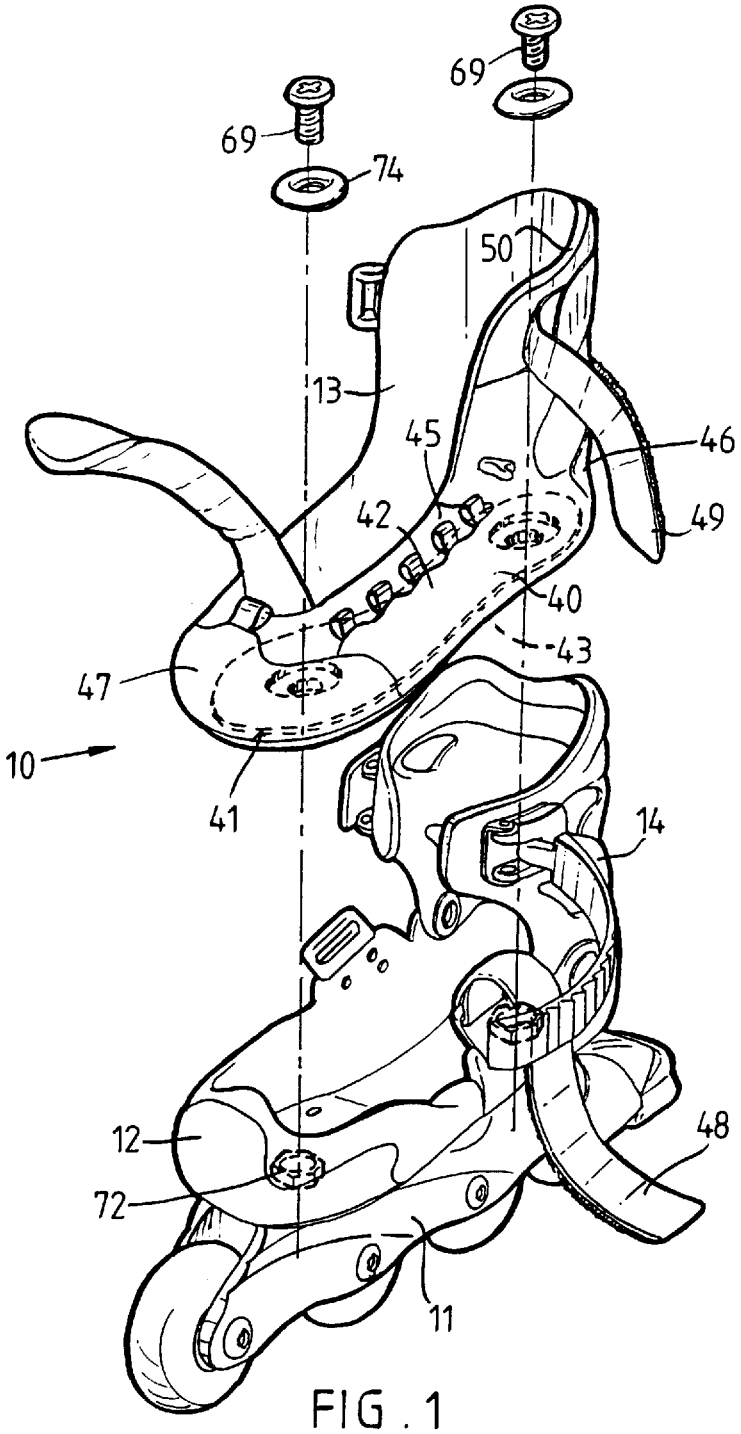
FIG. 1 is an exploded isometric view of the construction.
Figure 2:
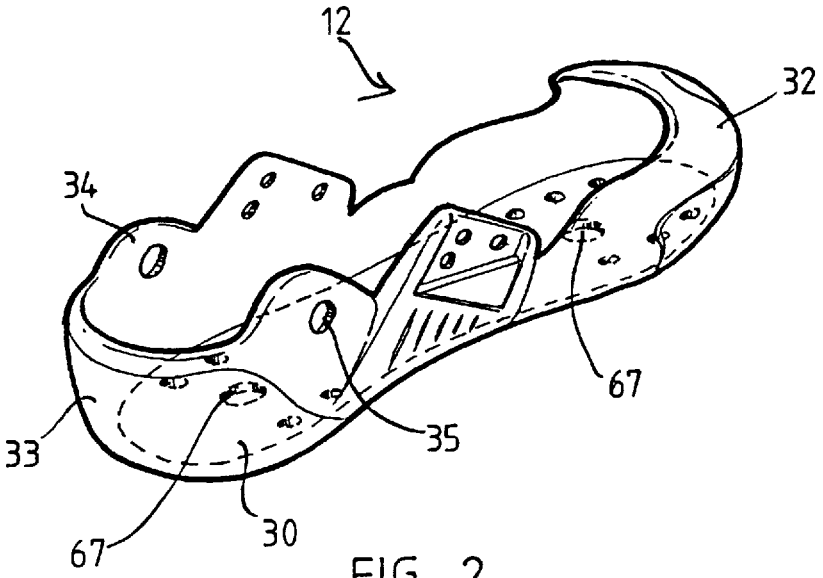
FIG. 2 is an isometric view of a foot frame.
Figure 3:
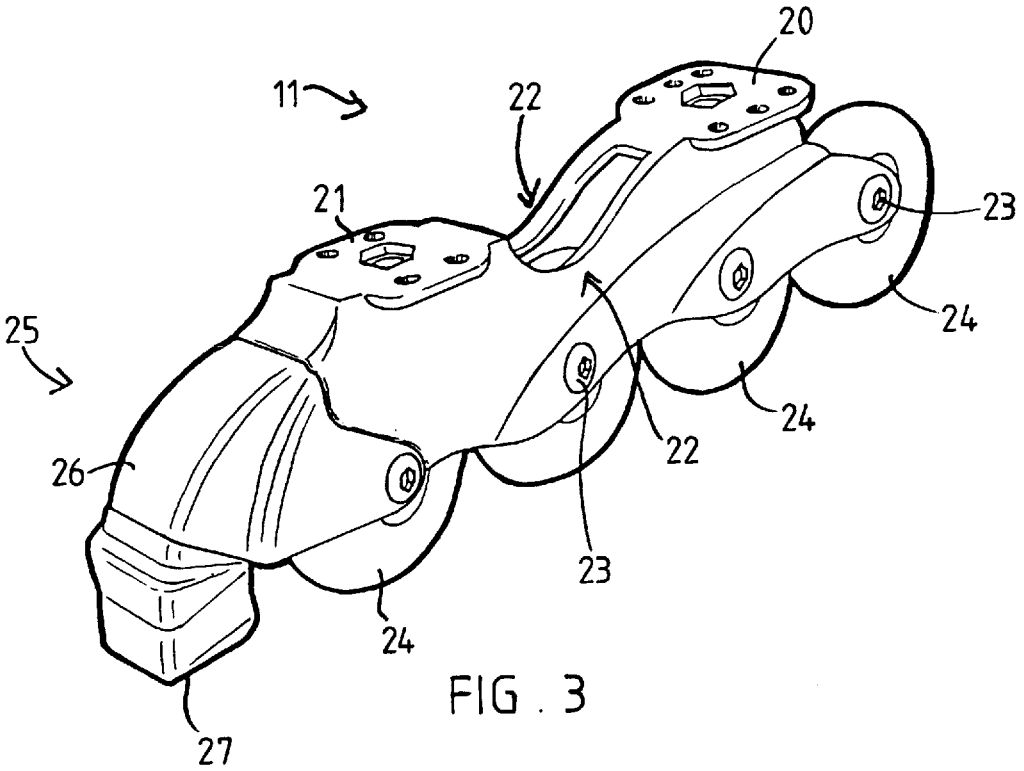
FIG. 3 is an isometric view of a chassis element.

In accordance with the invention, the device, generally indicated by reference character 10, comprises a rigid molded chassis element 11, a foot frame element 12, a shoe element 13, and a cuff element 14.

The chassis element 11 is of generally conventional configuration and formed as a synthetic resinous molding, including front and rear horizontal mounting flanges 20 and 21, interconnecting a pair of vertical plates 22, which support axles 23 rotatably engaging wheels 24 in known manner. The chassis element may include a brake element 25 including a pivotally mounted bracket 26 and ground-engaging member 27.

The foot frame element 12 is also preferably formed as a synthetic resinous molding. It includes a horizontal floor member 30 secured permanently by rivets (not shown) to the chassis element 11. Extending upwardly from the floor member is a toe member 32 forming a recess for engaging the shoe element 13 and a heel member 33 including integral upstanding cuff supports 34 having openings 35 for pivotal mounting.

The shoe element 13 (FIG. 1) is preferably formed from breathable textile or similar material used in the manufacture of athletic shoes. It includes a semi-rigid sole 40 bordered by a peripheral edge 41 and having upper and lower surfaces 42 and 43. The textile body 44 includes a vamp portion 45, a semi-rigid heel counter 46, and a semi-rigid toe portion 47 selectively engageable in the recess formed by the toe member 32. A vamp strap 48 is anchored to the foot frame element 12. An upper ankle enclosing portion 49 is bounded by an upper edge 50 positioned below and free of engagement with the leg surrounding part of the cuff element 14.

The cuff element 14 is formed from semi-rigid material, and includes a lower portion 56 having openings for penetration by securing rivets 58 which also engage the openings 35. The upper portion 59 is provided with a retaining strap 61 of known type.

Figure 4:
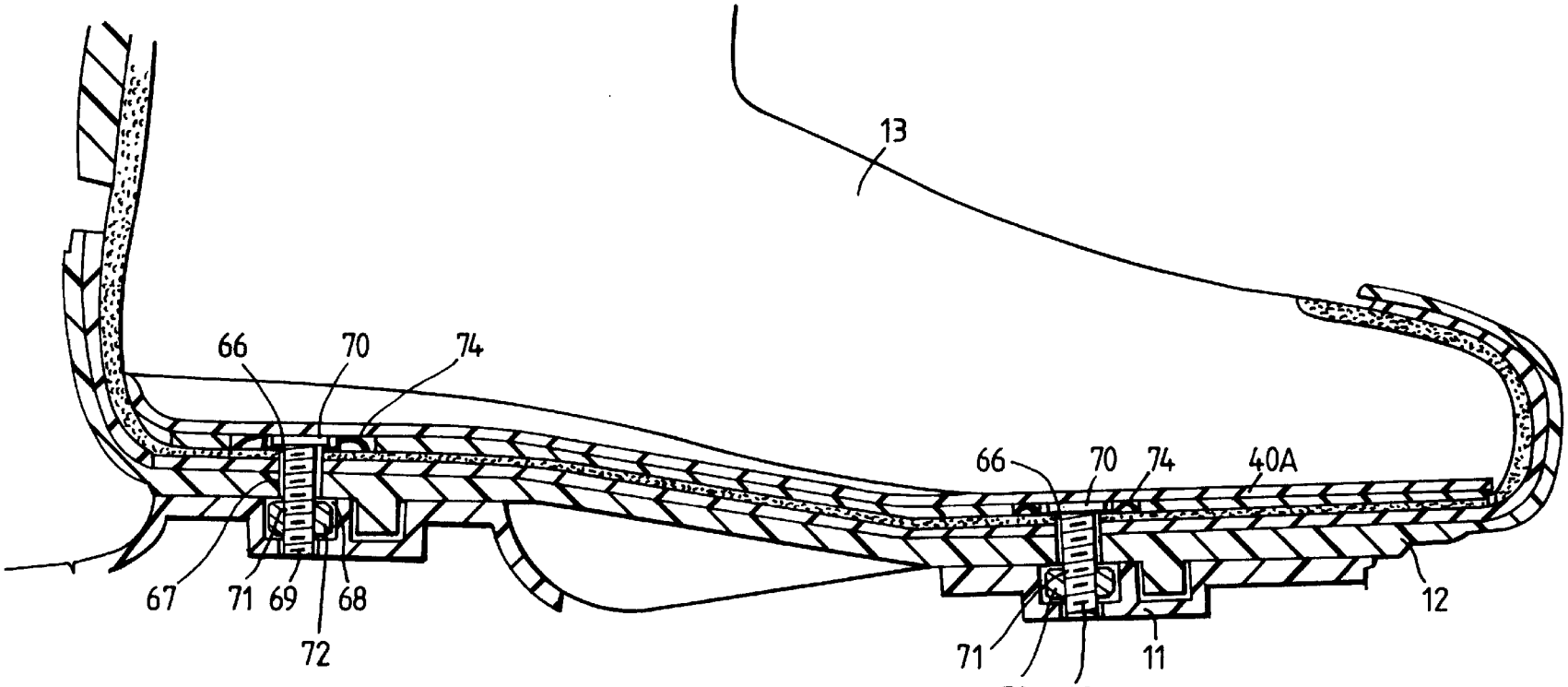
FIG. 4 is a sectional side view of the foot element and part of a shoe element.
Figure 5:
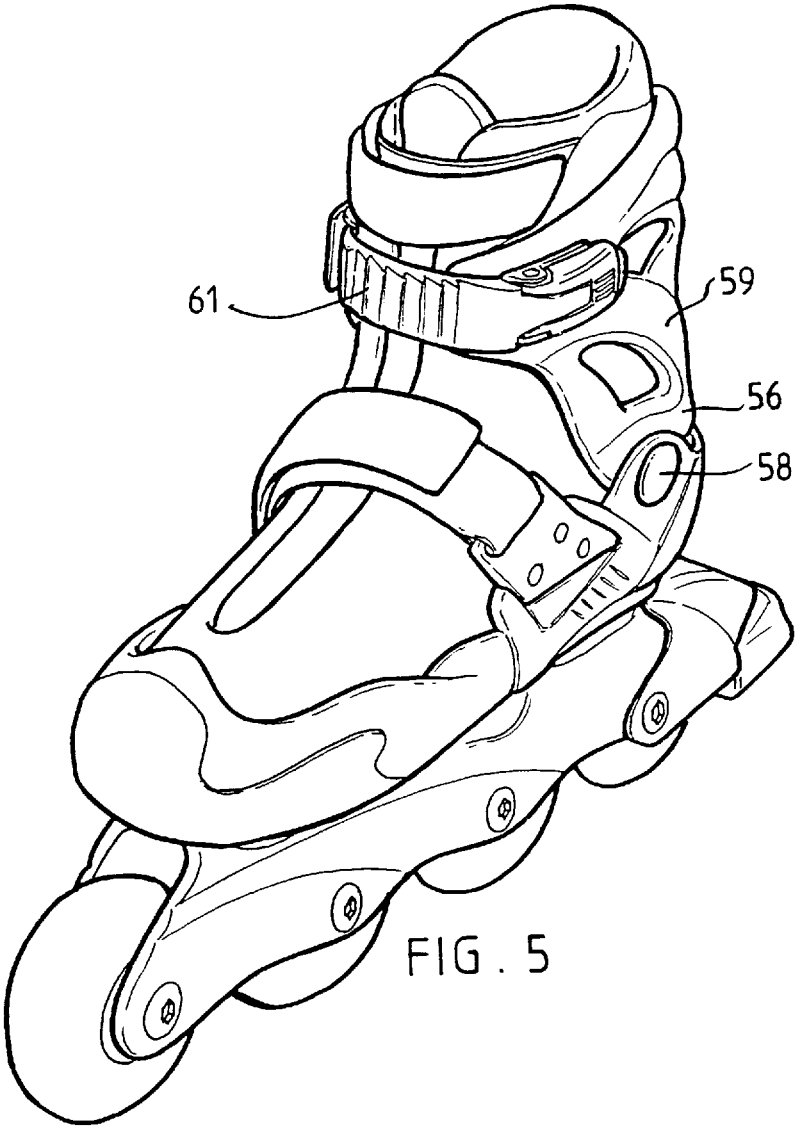
FIG. 5 is an isometric view of the assembled construction.

FIG. 4 in the drawing illustrates the attachment of the shoe element 13 to the foot frame element 12 and chassis element 11. This is accomplished by providing aligned openings 66, 67 and 68 positioned in the area of the heel and ball of the foot of the wearer. Threaded screws 69 include a head portion 70 accessible under a removable inner sole 40A, and a threaded shank portion 71 which extends through the openings 66–68 to be secured by a nut 72 or other locking device. The nuts may be welded or otherwise fixed or entrapped (see FIG. 4) to the chassis element or integrally molded with the chassis element to form threaded bosses for the screws 68.

To avoid pressure and discomfort otherwise caused by the head portion 70 upon the sole of the user, the head portion is positioned within a shaped washer 74 which may be formed either as a metallic stamping or a synthetic resinous molding. Normally, at least two threaded interconnections are necessary to prevent any vertical axis relative movement between the shoe element and the chassis element, although more points of interconnection may be provided where greater stress distribution upon the sole 40 is desired.

The shoe element may normally be removed from the remaining portions of the skate construction with the use of auxiliary tools. That is to say, the attaching and removing of the shoe element 13 can be carried out manually, even if a tool, such as a plug spanner or screwdriver, may be required. If desired, not only the nut, but the head and threaded shank of the fastener may be formed of synthetic resinous materials, such as nylon, which will eliminate any possibility of the formation of rust with the accompanying difficulty of unthreading the component parts.

It will be appreciated that the nut 72 may be wholly exposed and under the upper surface of the chassis element so to allow the nut to be turned to release the fastening screws 69 where preferred.

During skating, the flow of air and evaporation of moisture from the interior of the shoe element is facilitated by the fact that the upper edge 50 is exposed to the ambient air, and no constriction upon the ankle enclosing portion 49 is caused by the cuff element 14. Further, since the cuff may rotate about an axis through the rivets 58 without contacting the shoe element, no stress is placed upon the relatively light weight shoe element.

The above construction permits the shoe element to be worn independently of the remaining elements of the skate in detached condition, thereby enabling the user to avoid the necessity of carrying an additional pair of shoes for use when the skates are in detached condition. The construction also permits the accommodation of shoe elements of varying sizes within a reasonable range, so long as the openings in the sole are properly positioned. This is possible because the engagement of the toe portion of the shoe element within the recess in the frame element is not wholly relied upon to secure engagement of the front portion of the shoe element.

We wish it to be understood that we do not consider the invention to be limited to the precise details of structure shown and set forth in the specification, for obvious modifications will occur to those skilled in the art to which the invention pertains.

What is claimed is:

1. In an in-line skate construction including a wheel mounting chassis, a foot frame carried by said chassis, a cuff pivotally mounted upon said foot frame, and a shoe element mounted upon said foot frame, the improvement comprising: means for detachably interconnecting said shoe element upon said foot frame, said means including a plurality of aligned openings in said shoe, said foot frame and said chassis; and manually operable fastening means extending through said aligned openings accessible from the interior of said shoe at a first end thereof to secure the shoe element to said chassis.

2. The improvement in accordance with claim 1, said fastening means including a threaded screw having a head portion within said shoe, a shank portion extending through said aligned openings, and a threaded nut engaging said shank portion.

3. The improvement in accordance with claim 2, further comprising a shaped washer forming a recess corresponding to an outer periphery of said head portion of said screw, said head portion being positioned within said recess.

4. The improvement in accordance with claim 1, including a vamp strap anchored to the foot frame element.

* * * * *